United States Patent [19]

Gosslar et al.

[11] Patent Number: 4,658,177

[45] Date of Patent: Apr. 14, 1987

[54] ELECTRIC LAMP WITH ORIENTED CURRENT CONDUCTORS EXTENDING THROUGH A PRESS SEAL

[75] Inventors: Achim Gosslar; Jürgen Heider, both of Munich, Fed. Rep. of Germany

[73] Assignee: Patent-Treuhand Gesellschaft für elektrische Glühlampen mbH, Munich, Fed. Rep. of Germany

[21] Appl. No.: 752,155

[22] Filed: Jul. 3, 1985

[30] Foreign Application Priority Data

Jul. 13, 1984 [DE] Fed. Rep. of Germany ..... 3425894

[51] Int. Cl.[4] ..... H01J 5/46; H01J 5/50; H01J 61/34; H01J 61/36

[52] U.S. Cl. ..... 313/25; 313/574; 313/252; 313/623

[58] Field of Search ..... 313/25, 578, 579, 580, 313/623, 574, 252; 445/33, 49, 63, 67, 69

[56] References Cited

U.S. PATENT DOCUMENTS

| | | | |
|---|---|---|---|
| 2,875,358 | 2/1959 | Rigden | 313/623 X |
| 4,535,269 | 8/1985 | Tschetter et al. | 313/25 X |
| 4,542,316 | 9/1985 | Hall et al. | 313/623 X |

*Primary Examiner*—David K. Moore
*Assistant Examiner*—K. Wieder
*Attorney, Agent, or Firm*—Frishauf, Holtz, Goodman & Woodward

[57] ABSTRACT

To insure orientation of internal current leads (9, 10; 23, 24) extending from a press seal (14, 27) at the end of a bulb (3, 28) inwardly thereof, small metal elements (19, 20; 31, 32), preferably of the same material as the inwardly extending current leads, are connected, for example by welding, to the inwardly extending current leads, the small metal elements being oriented to extend transversely to the major direction of the current leads and positioned in a plane determined by the plane of the press seal.

9 Claims, 3 Drawing Figures

ELECTRIC LAMP WITH ORIENTED CURRENT CONDUCTORS EXTENDING THROUGH A PRESS SEAL

Reference to related publication:
U.S. Pat. No. 4,254,356.

The present invention relates to electric lamps, and more particularly to electric lamps having a lamp bulb of glass such as hard glass, or quartz, in which the bulb is sealed by a press through which a sealing foil, typically a molybdenum foil, extends to form an electrical connection between an internal and an external conductor extending into the press and, respectively, inwardly and outwardly of the lamp bulb.

BACKGROUND

The manufacture of lamps having a press through which a metal foil, typically a molybdenum foil, extends to form an electrical conductor is difficult since problems arise in connection with alignment and directing the current conductors which lead from the outside of the lamp bulbs towards the inside thereof, and more particularly to insure proper alignment of the internal conductors while the lamp press is being formed. The sealing foils usually are very thin—frequently less than 0.05 mm thickness, are tiny, and thus have practically no stiffness. Alignment of external current conductors can be transferred towards the inner current conductors only to a limited degree, and, hence, the lamp elements which will be placed within the bulb are also difficult to keep in alignment. Some constructions have been used in which support elements are employed which are coupled to lamp parts and are supported on or support against the inner wall of the bulb. Such arrangements are expensive, difficult to make, and cause shadow effects in the light output from the lamp, which is undesirable.

It has previously been proposed to stiffen the metal foils used in a discharge lamp by folding the edges of the sealing foils in zig-zag formation, so that, in cross section, they will have generally Z-shape (see U.S. Pat. No. 4,254,356).

The corrugation or Z-folding of the foil is intended to increase the stiffness thereof and to thus insure better alignment of the electrodes of the discharge lamp. For hermetic sealing, the subassembly is introduced into the neck of the bulb, and the neck is then heated in the region of the sealing foil until it collapses. This arrangement permits a somewhat improved centering due to the stiffening of the sealing foil; it does not, however, use a lamp press with the attendant advantages of a press seal.

THE INVENTION

It is an object to provide a simple and inexpensive arrangement which permits precise alignment of the internal current conductors or leads, so that the lamp parts—electrodes or filaments—then will be precisely aligned, the press sealing step fixing the alignment in position; a vacuum-tight seal is desired, which can be obtained by a press sealing in the region of the sealing foils.

Briefly, and in accordance with the present invention, the inner current conductors or leads have small elements of a high temperature resistant metal, such as tantalum, molydenum or tungsten attached thereto, extending transversely to the major direction of the current carrying leads, and located in a plane determined by the central longitudinal plane of the press or press seal.

The metallic elements or parts, which may be sheet-metal elements, small wire elements or the like, are secured to the internal leads by means of a jig. The transversely extending metal elements prevent twist or inclination of the inner current carrying or current supply leads which might occur during the press sealing operation, and insure precise alignment of all lamp parts which are attached to the inwardly extending current leads or connections.

Preferably, the metallic elements are made of wire or sheet metal of the same material as that of the inner current leads or conductors, and are connected thereto by welding. If sheet metal is used, it may be circular, oval or rectangular or have any other desired shape. When using the same materials for the inwardly extending leads as for the transversely extending metal parts, fissures and hair cracks due to different temperature coefficients of expansion are effectively prevented. The metallic elements preferably extend at right angle to the inner current supply leads, thus insuring optimum alignment of the lamp parts which are held by the current supply leads.

The internal construction of the lamp can be as desired; the lamp may, for example, be a high-pressure discharge lamp in which the press-sealed tube forms an external bulb, and the inner current supply leads form electrical connection for a discharge vessel or discharge or arc tube or vessel within the external bulb. In such lamps, precise alignment of the discharge vessel within the outer bulb is of substantial importance since such lamps are usually used in fixtures having reflectors, so that the position of the arc with respect to the reflector must be accurately determined. To obtain uniform illumination from the fixture, that is, from the reflector with which the light source is used, it is necessary that the center of the discharge arc is located at a precisely positioned point within the lamp.

If the discharge lamp does not include fillers which are difficult to vaporize or attack glass, the electric lamp may require only a single discharge vessel, without an outer bulb; in such case, the electrodes will be attached to the inwardly extending conductors or leads directly.

The lamp may, however, also be of an entirely different construction, namely an incandescent lamp, having a filament extending between two electrode leads, for example a halogen incandescent lamp. In such case, the lamp bulb will retain the inwardly directed leads whcih carry the end portions of the filament, the bulb being sealed by the press. The metal parts which are bonded to the inwardly extending current leads, for example by welding, prevent twisting or straining of the incandescent filament, and thus contribute to extended life of such a lamp.

Adding a tiny metal part, extending transversely to the major direction of the inwardly extending current lead or conductor, has an additional advantage: In the production process of many lamps of this type, it is customary to blow an inert gas through the lamp bulb at an opening remote from the press, in order to prevent oxidation of the foils embedded in the press. The tiny metal parts, attached to the inwardly extending leads, will counteract an inclination of the discharge vessel, if a double-walled highpressure lamp is made, or of the incandescent filament, if an incandescent lamp is made, caused by the stream of inert gas. Thus, the part can further contribute to initial alignment of the electrical lamp element attached to the inwardly extending current lead or conductor.

DRAWINGS

Figure 2:
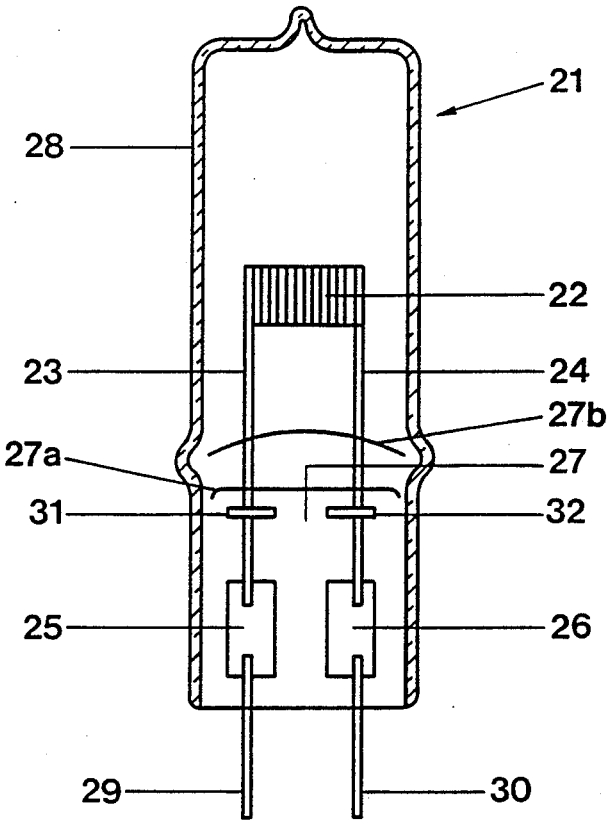
FIG. 2 is a side view of a halogen incandescent lamp.
Figure 2A:
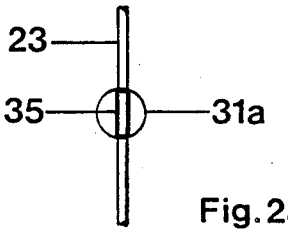

FIG. 2*a* is a fragmentary view of the alignment part showing another embodiment.

In the drawings, only those elements necessary for an understanding of the invention are shown, other lamp components, which are standard in the lamp construction, having been omitted.

DETAILED DESCRIPTION

Figure 1:
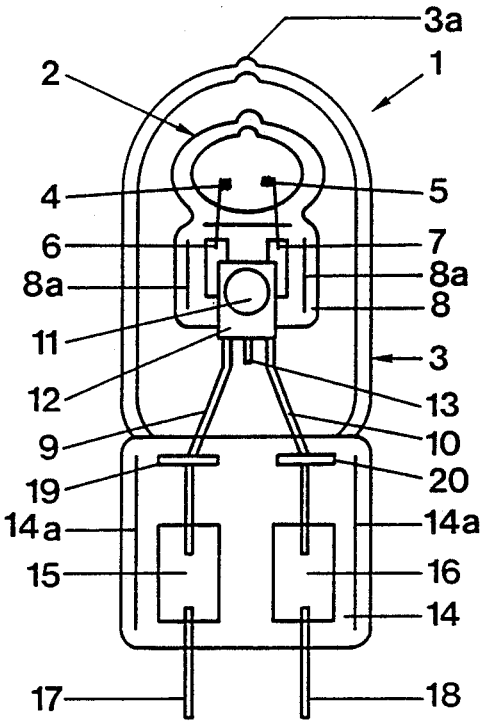
FIG. 1 is a front view of a double-walled or double-bulb high-pressure discharge lamp.

FIG. 1 illustrates, schematically, a metal halogen highpressure discharge lamp 1, which has an outer bulb 3 of quartz glass and therein a discharge or arc vessel 2, spaced closely from the outer bulb 3. Tungsten electrodes 4, 5 are connected to sealing foils 6, 7 which are embedded in a press 8 of the discharge vessel or arc vessel 2. Lines 8*a* schematically indicate the press lines. The molybdenum foils 6, 7 are connected to current supply leads 9, 10 extending inwardly within the outer bulb 3. The leads or connecting wires 9, 10 are made of molybdenum and have a thickness of about 0.5 mm. A getter 11 is secured in or on the press 8, the getter including a zirconium compound, attached to a metallic support 12 by a holding wire 13. Holding wire 13 is free from voltage, and not connected to any one of the electrodes. The inwardly extending current supply leads 9, 10 are connected via sealing foils 15, 16, likewise of molybdenum, to outwardly extending current supply leads 17, 18, which, preferably, are also made of molybdenum. Portions of the inner supply leads 9, 10, the outwardly extending leads 17, 18, and the entirety of the intermediate sealing foils 15, 16 are located within the press seal 14, closing off the outer bulb 3. Press seal lines are seen at 14*a*.

In accordance with the invention, inwardly leading current supply leads 9, 10 have attached thereto short wire elements 19, 20, of about 5 mm length, and of a thickness which corresponds to that of the inner current supply leads 9, 10, that is, about 0.5 mm diameter. The parts 19, 20 extend at right angles to the major current supply leads 9, 10. The elements 19, 20 are attached to the leads 9, 10 prior to the press operation, and before being introduced into the outer bulb 3, by a weld connection. Alignment of the elements 19, 20 on the supply leads 9, 10 is obtained by a jig or other similar alignment element. Upon forming the press seal 14, optimum alignment of the discharge vessel 2 within the center of the outer bulb 3 is obtained. During the formation of the press seal, the bulb 3 is open at the exhaust tip 3*a*, and an inert gas is introduced in axial direction of the lamp. The inert gas flow may cause the discharge vessel 2 to incline in a certain direction. The elements 19, 20 counteract an inclination of the discharge vessel 2 during the press sealing operation, and hence ensure alignment of the discharge vessel 2 axially and precisely within the center of the outer bulb 3.

The bulb 2 has a fill of NaI, $SnI_2$, TlI, Hg and Ar; the internal volume of the bulb 3 is 0.27 $cm_3$ and, at a power consumption of 70 W, a light output of about 65 lm/W is obtained.

After the press seal 14 has been formed, the lamp is finished and tipped off in accordance with standard procedure.

Embodiment of FIG. 2: A halogen incandescent lamp 21, of 400 W rated power, has a tungsten filament 22 which is connected to inwardly extending current supply leads 23, 24, likewise made of tungsten, which simultaneously form the end holding elements for the filament 22. The supply leads 23, 24 are connected, for example by welding, to molybdenum foils 25, 26 which are located within the press 27 of the bulb 28. The bulb 28 is made of quartz glass. The molybdenum foils 25, 26 are connected to external current supply leads 29, 30 which, in turn, are connected to external lamp terminals in a lamp base—not shown—and which may be of any suitable and standard construction.

In accordance with a feature of the invention, short wire elements 31, 32, likewise made of molybdenum, are connected by welding to the current supply leads 23, 24. The molybdenum foils as well as the wire elements 31, 32 are located within the press 27. The press seal itself extends to line 27*a*, although the stem holder portion, which may be part of the press, or set within a slight bulge in the outer bulb, may extend further up, to line 27*b*.

The elements 31, 32, in a halogen incandescent lamp of 400 W, may each have a length of about 3 mm, and insure that, upon making the press 27, the leads 23, 24 will be precisely aligned, so that a twist, offset, or strain placed on the filament 22 is reliably prevented.

FIG. 2*a* shows a modification, in which elements 31*a*, of sheet metal, are welded by weld 35 to the lead 23. Of course, a similar construction may be used with the embodiment of FIG. 1, and the sheet-metal element may have a different configuration from the circular element as shown, for example oval, rectangular, or the like.

Various changes and modifications may be made, and features described in connection with any one of the embodiments may be used with any of the others, within the scope of the inventive concept.

We claim:

1. Electrical lamp having a bulb (3, 28) of glass or quartz;
   - external current leads (17,18; 29, 30) leading from outside of the bulb towards the inside thereof;
   - internal current leads (9, 10; 23, 24) extending inwardly of the bulb;
   - lamp elements (2-12; 22) supported on said internal current leads (9, 10; 23, 24);
   - sealing foils (15,16; 25, 26) bonded to and connecting respective external and internal leads; and
   - a press seal (14, 27) sealing the bulb with respect to the outside and embedding the sealing foils, comprising,
   - means formed into said press seal (14, 27) for mechanically aligning the internal current leads leads (9, 10; 23, 24) and the lamp elements supported thereon including
   - metal elements (19, 20; 31, 32) made of high temperature resistant metal, secured to the internal current leads in position to extend transversely to the major direction of said internal current leads and of current flow therein, and positioned in a plane parallel to a central longitudinal plane of the press seal by formation of said seal.

2. Lamp according to claim 1, wherein the metal elements (19, 20; 31, 32) comprise wire elements.

3. Lamp according to claim 1, wherein the metal elements comprise sheet-metal elements (31*a*).

4. Lamp according to claim 1, wherein the metal elements (19, 20) are made of the same material as the internal current leads (9, 10).

5. Lamp according to claim 1, wherein the metal elements (19, 20; 31, 32) are connected to the internal current leads (9, 10; 23, 24) by a weld connection (35).

6. Lamp according to claim 1, wherein the electric lamp comprises a high-pressure discharge lamp including an inner arc or discharge vessel (2) and wherein the bulb (3) constitutes the outer surrounding bulb, within which the inner discharge or arc vessel is located, and the internal current leads (9, 10) form connections between electrodes (4, 5) located within the arc or discharge vessel and connecting leads extending inwardly of the outer bulb (3) for connection to the electrodes within the arc or discharge vessel.

7. Lamp according to claim 1, wherein the electric lamp comprises a halogen incandescent lamp, the bulb (28) is formed with the press seal (27), and the internal current leads (23, 24) include the holding elements for an incandescent filament (22) located within the bulb (28).

8. Lamp according to claim 1, wherein the metal elements (19, 20; 31, 32) comprise tantalum, molybdenum or tungsten.

9. Lamp according to claim 8, wherein the metal elements (19, 20; 31, 32) are wire elements of between about 3 to 5 mm length.

* * * * *